US009850789B2

(12) United States Patent
Son et al.

(10) Patent No.: US 9,850,789 B2
(45) **Date of Patent: *Dec. 26, 2017**

(54) CONTINUOUS VARIABLE VALVE DURATION APPARATUS AND ENGINE PROVIDED WITH THE SAME

(71) Applicant: Hyundai Motor Company, Seoul (KR)

(72) Inventors: You Sang Son, Suwon-si (KR); Kyoung Pyo Ha, Seongnam-si (KR); Back Sik Kim, Osan-si (KR)

(73) Assignee: Hyundai Motor Company, Seoul (KR)

( * ) Notice: Subject to any disclaimer, the term of this patent is extended or adjusted under 35 U.S.C. 154(b) by 116 days.

This patent is subject to a terminal disclaimer.

(21) Appl. No.: 14/942,671

(22) Filed: Nov. 16, 2015

(65) Prior Publication Data

US 2017/0089230 A1 Mar. 30, 2017

(30) Foreign Application Priority Data

Sep. 24, 2015 (KR) ..... 10-2015-0135844

(51) Int. Cl.
*F01L 1/34* (2006.01)
*F01L 13/00* (2006.01)

(52) U.S. Cl.
CPC ..... *F01L 13/0036* (2013.01); *F01L 13/0047* (2013.01); *F01L 2013/0052* (2013.01)

(58) Field of Classification Search
CPC ..... F01L 13/0047; F01L 13/0036; F01L 2013/0052
USPC ..... 123/90.16, 90.39, 90.44, 90.27, 90.31, 123/90.6
See application file for complete search history.

(56) References Cited

U.S. PATENT DOCUMENTS 5,924,334 A 7/1999 Hara et al.
8,813,704 B2 * 8/2014 Kim ..... F01L 1/0532 123/90.16
9,512,748 B2 12/2016 Kim et al.

FOREIGN PATENT DOCUMENTS

JP 6-185321 A 7/1994
JP 9-41924 A 2/1997
JP 5582195 B2 7/2014

* cited by examiner

*Primary Examiner* — Ching Chang
(74) *Attorney, Agent, or Firm* — Morgan, Lewis & Bockius LLP

(57) ABSTRACT

A continuous variable valve duration apparatus may include camshaft, first and second cam portions of cam is formed thereto respectively, of which the camshaft is inserted thereto and of which relative phase angles with respect to the camshaft are variable, first and second inner brackets transmitting rotation of the camshaft to the first and second cam portions respectively, first and second slider housings of which the first and second inner brackets are rotatably inserted thereto and of which relative position with respect to the camshaft are variable, cam cap rotatably supporting the first and second cam portions respectively and of which each slider housing is slidably mounted thereto, control shaft disposed parallel to the camshaft and engaged with the first and second slider housings for selectively moving the first and second slider housings and a control portion selectively rotating the control shaft for changing positions of the inner brackets.

20 Claims, 10 Drawing Sheets

CONTINUOUS VARIABLE VALVE DURATION APPARATUS AND ENGINE PROVIDED WITH THE SAME

CROSS-REFERENCE TO RELATED APPLICATION

The present application claims priority to and the benefit of Korean Patent Application No. 10-2015-0135844 filed on Sep. 24, 2015, the entire contents of which is incorporated herein for all purposes by this reference.

BACKGROUND OF THE INVENTION

Field of the Invention

The present invention relates to a continuous variable valve duration apparatus and an engine provided with the same. More particularly, the present invention relates to a continuous variable valve duration apparatus an engine provided with the same which may vary opening duration of a valve according to operation conditions of an engine with a simple construction.

Description of Related Art

An internal combustion engine generates power by burning fuel in a combustion chamber in an air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

Optimal operation of the intake valves and the exhaust valves depends on a rotation speed of the engine. That is, an optimal lift or optimal opening/closing timing of the valves depends on the rotation speed of the engine. In order to achieve such optimal valve operation depending on the rotation speed of the engine, various researches, such as designing of a plurality of cams and a continuous variable valve lift (CVVL) that can change valve lift according to engine speed, have been undertaken.

Also, in order to achieve such an optimal valve operation depending on the rotation speed of the engine, research has been undertaken on a continuously variable valve timing (CVVT) apparatus that enables different valve timing operations depending on the engine speed. The general CVVT may change valve timing with a fixed valve opening duration.

However, the general CVVL and CVVT are complicated in construction and are expensive in manufacturing cost.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directly providing a continuous variable valve duration apparatus and an engine provided with the same which may vary opening duration of a valve according to operation conditions of an engine, with a simple construction.

A continuous variable valve duration apparatus an exemplary embodiment of the present invention may include a camshaft, a first and second cam portions of a cam is formed thereto respectively, of which the camshaft is inserted thereto and of which relative phase angles with respect to the camshaft are variable, a first and second inner brackets transmitting rotation of the camshaft to the first and second cam portions respectively, a first and second slider housings of which the first and second inner brackets are rotatably inserted thereto and of which relative position with respect to the camshaft are variable, a cam cap rotatably supporting the first and second cam portions respectively and of which each slider housing is slidably mounted thereto, a control shaft disposed parallel to the camshaft and engaged with the first and second slider housings for selectively moving the first and second slider housings and a control portion selectively rotating the control shaft for changing positions of the inner brackets.

A cam key may be formed to the first and second cam portions respectively and a first sliding hole may be formed to the first and second inner brackets respectively and wherein the continuous variable valve duration apparatus may further include a cam key pin of which a cam key slot where the cam key is slidably inserted therein is formed thereto and the cam key pin rotatably inserted into the each first sliding hole.

A second sliding hole may be formed to the first and second inner brackets respectively, and wherein the continuous variable valve duration apparatus may further include a plurality of camshaft pin connected to the camshaft and a slider pin of which a camshaft pin slot where the camshaft pin is slidably inserted therein is formed thereto and the slider pin rotatably inserted into the each second sliding hole.

A shaft hole where the control shaft is inserted into may be formed to the cam cap.

The continuous variable valve duration apparatus may further include a shaft bearing inserted into the shaft hole and rotatably supporting the control shaft.

A guide slot may be formed to the cam cap, a guide shaft inserted into the guide slot and of which a rack gear is formed thereto may be protruded from the slider housing and a pinion gear may be formed to the control shaft and engaged with the rack gear and wherein the positions of the slider housings may be changed according to rotation of the control shaft.

The continuous variable valve duration apparatus may further include a bushing inserted into the guide slot for reducing frictional force of the movement of the guide shaft.

The continuous variable valve duration apparatus may further include a stopper disposed to the cam cap for limiting the movement of the slider housing.

The continuous variable valve duration apparatus may further include a slider housing bearing disposed between the slider housing and the first and second inner brackets respectively.

The cam may be formed as a pair, a cam cap connecting portion may be formed between the two cams of the cam portions and the cam cap may rotatably support the cam cap connecting portion.

The control portion may include a worm wheel connected to the control shaft, a worm gear engaged with the worm wheel and a control motor selectively rotating the worm gear.

The continuous variable valve duration apparatus may further include a partition disposed within the first and second slider housings respectively for preventing from interrupting of the rotations of the inner brackets.

An engine an exemplary embodiment of the present invention may include a camshaft, two first and second cam portions of a cam is formed thereto respectively, of which the camshaft is inserted thereto, of which relative phase angles with respect to the camshaft are variable and a cam key is formed thereto respectively, a plurality of camshaft pin connected to the camshaft, a first and second inner brackets transmitting rotation of the camshaft pins to the cam keys respectively, a first and second slider housings of which the first and second inner brackets are rotatably inserted thereto and of which relative position with respect to the camshaft are variable, cam caps rotatably supporting the first and second cam portions together with a cylinder head and of which the slider housings are slidably mounted thereto respectively, a control shaft disposed parallel to the camshaft and engaged with the first and second slider housings for selectively moving the first and second slider housings and a control portion selectively rotating the control shaft for changing positions of the inner brackets.

The control portion may include a worm wheel connected to the control shaft, a worm gear engaged with the worm wheel and a control motor selectively rotating the worm gear.

A first and second sliding holes may be formed to the first and second inner brackets respectively, and wherein the continuous variable valve duration apparatus may further include a cam key pin of which a cam key slot where the cam key is slidably inserted therein is formed thereto and the cam key pin rotatably inserted into the each first sliding hole and a slider pin of which a camshaft pin slot where the camshaft pin is slidably inserted therein is formed thereto and the slider pin rotatably inserted into the each second sliding hole.

The engine may further include a slider housing bearing disposed between the slider housing and the first and second inner brackets respectively.

The cam may be formed as a pair, a cam cap connecting portion may be formed between the two cams of the cam portions and wherein cam cap connecting portion may be rotatably disposed between the cam cap and the cylinder housing.

A guide slot may be formed to the cam cap and a shaft hole where the control shaft is inserted into may be formed to the cam cap, and wherein the engine may further include a shaft bearing inserted into the shaft hole and rotatably supporting the control shaft.

A guide slot may be formed to the cam cap, a guide shaft inserted into the guide slot and of which a rack gear is formed thereto may be protruded from the slider housing and a pinion gear may be formed to the control shaft and engaged with the rack gear and wherein the positions of the slider housings may be changed according to rotation of the control shaft.

A guide surface may be formed to the first and second slider housings and a guider may be formed to the cylinder head for contacting the guide surface and guiding movements of the first and second slider housings.

As described above, a continuous variable valve duration apparatus according to an exemplary embodiment of the present invention may vary an opening duration of a valve according to operation conditions of an engine, with a simple construction.

The continuous variable valve duration apparatus according to an exemplary embodiment of the present invention may be reduced in size and thus the entire height of a valve train may be reduced.

Since the continuous variable valve duration apparatus may be applied to an existing engine without excessive modification, thus productivity may be enhance and production cost may be reduced.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
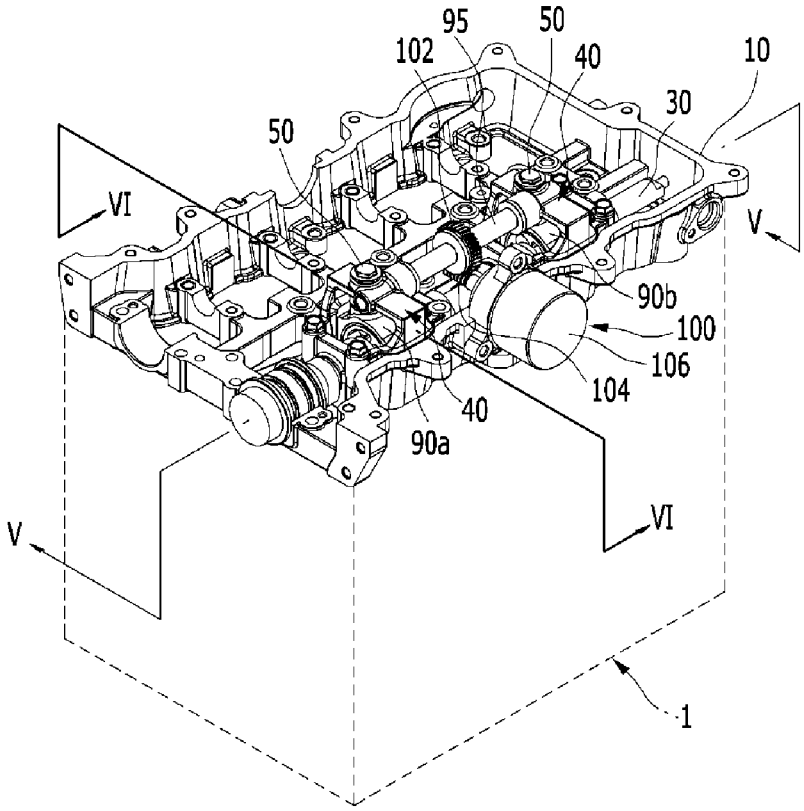
FIG. 1 is a perspective view of an engine provided with a continuous variable valve duration apparatus according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

In the following detailed description, only certain exemplary embodiments of the present invention have been shown and described, simply by way of illustration.

As those skilled in the art would realize, the described embodiments may be modified in various different ways, all without departing from the spirit or scope of the present invention A part irrelevant to the description will be omitted to clearly describe the present invention, and the same or similar elements will be designated by the same reference numerals throughout the specification.

In the drawings, the thickness of layers, films, panels, regions, etc., are exaggerated for clarity.

Throughout the specification and the claims, unless explicitly described to the contrary, the word "comprise" and variations such as "comprises" or "comprising", will be understood to imply the inclusion of stated elements but not the exclusion of any other elements.

An exemplary embodiment of the present invention will hereinafter be described in detail with reference to the accompanying drawings.

Figure 2:
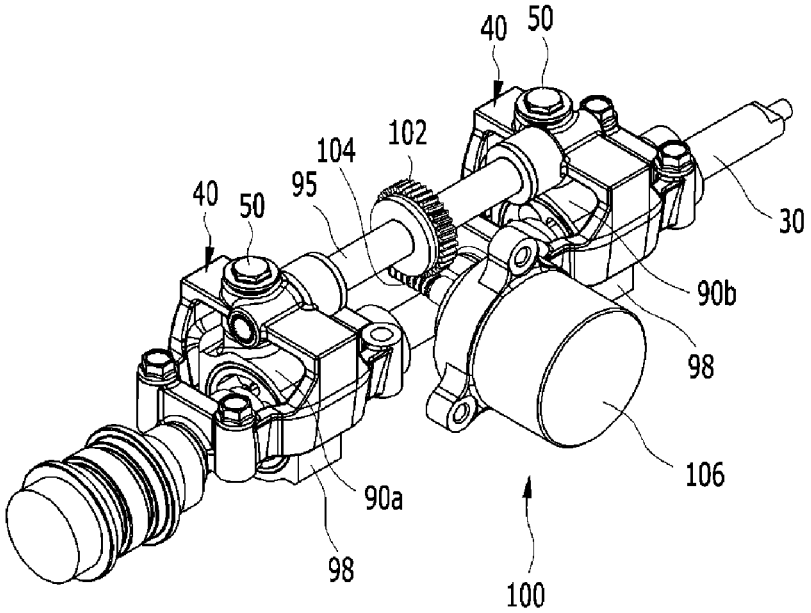
FIG. 2 is a perspective view of a continuous variable valve duration apparatus according to an exemplary embodiment of the present invention.

FIG. 1 is a perspective view of an engine provided with a continuous variable valve duration apparatus according to an exemplary embodiment of the present invention and FIG. 2 is a perspective view of a continuous variable valve duration apparatus according to an exemplary embodiment of the present invention.

Figure 3:
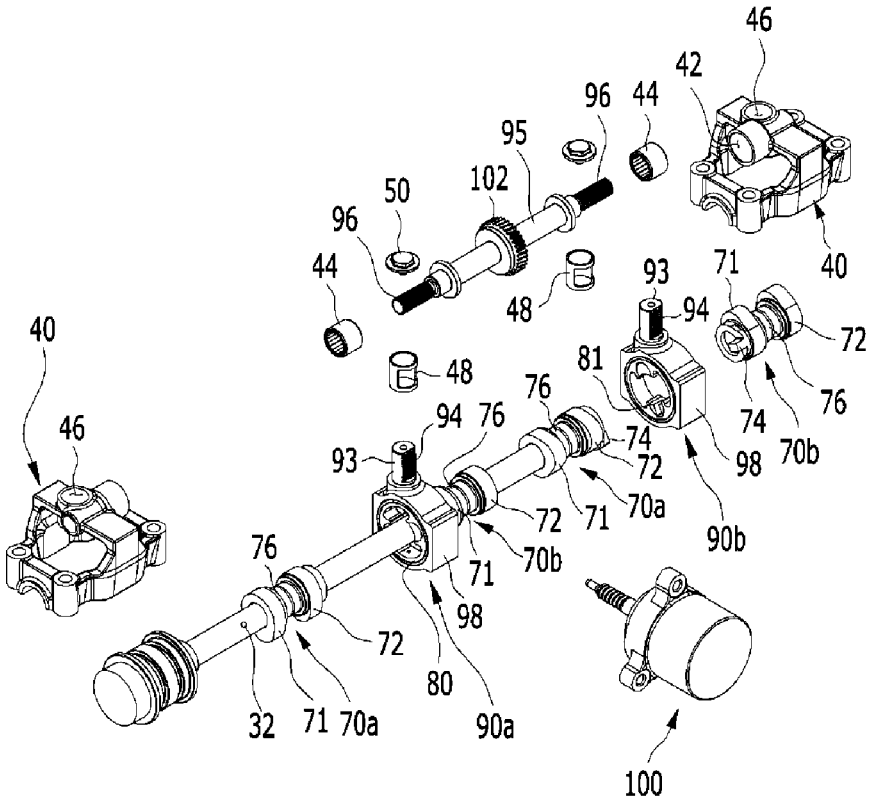
FIG. 3 and FIG. 4 are exploded perspective views of a continuous variable valve duration apparatus according to an exemplary embodiment of the present invention.
Figure 4:
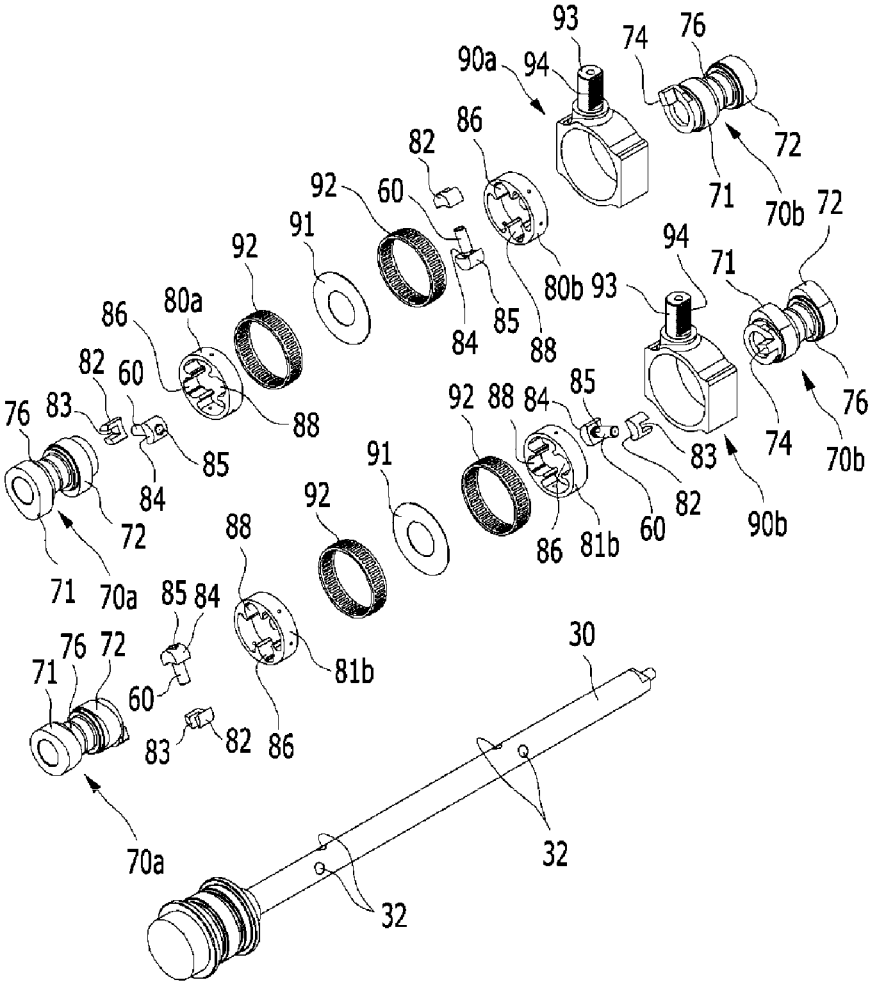
Figure 5:
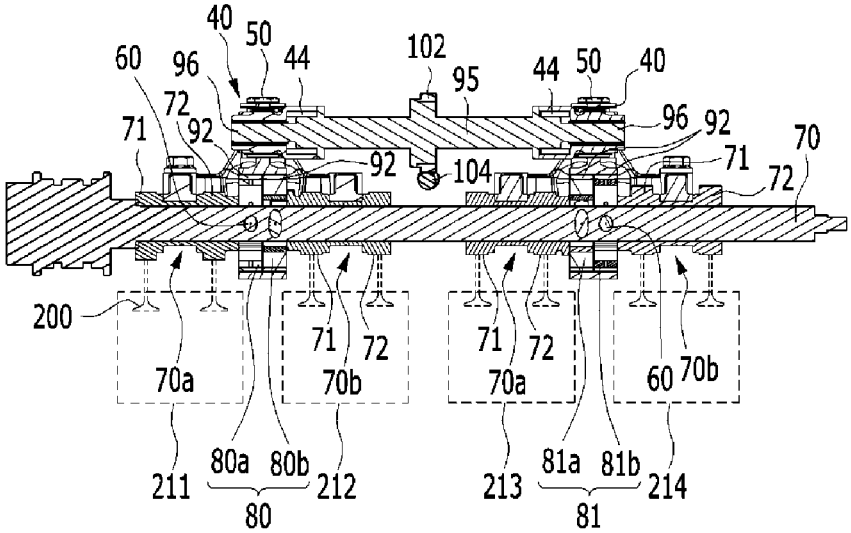
FIG. 5 is a cross-sectional view along line V-V of FIG. 1.
Figure 6:
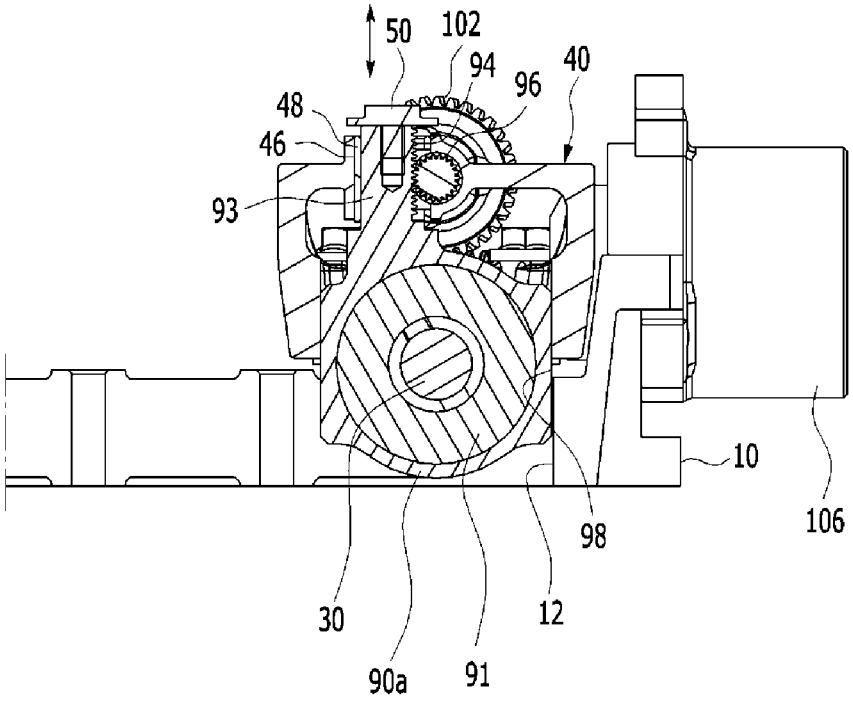
FIG. 6 is a cross-sectional view along line VI-VI of FIG. 1.

FIG. 3 and FIG. 4 are exploded perspective views of a continuous variable valve duration apparatus according to an exemplary embodiment of the present invention and FIG. 5 is a cross-sectional view along line V-V of FIG. 1.

Referring to FIG. 1 to FIG. 6, an engine 10 according to an exemplary embodiment of the present invention includes a cylinder head 10 and a continuous variable valve duration apparatus mounted to the cylinder head 10.

The continuous variable valve duration apparatus includes a camshaft 30, a first and second cam portions 70*a* and 70*b* of which a cam 71 and 72 is formed thereto respectively, of which the camshaft 30 is inserted thereto and of which relative phase angles with respect to the camshaft 30 are variable, a first and second inner brackets 80 and 81 transmitting rotation of the camshaft 30 to the first and second cam portions 70*a* and 70*b* respectively, a first and second slider housings 90*a* and 90*b* of which the first and second inner brackets 80*a* and 80*b* are rotatably inserted thereto and of which relative position with respect to the camshaft 30 are variable, a cam cap 40 rotatably supporting the first and second cam portions 70*a* and 70*b* respectively and of which each slider housing 90*a* and 90*b* is slidably mounted thereto, a control shaft 95 disposed parallel to the camshaft 30 and engaged with the first and second slider housings 90*a* and 90*b* for selectively moving the first and second slider housings 90*a* and 90*b* and a control portion 100 selectively rotating the control shaft 95 for changing positions of the inner brackets 80*a* and 80*b*.

The engine includes a plurality of cylinders 211, 212, 213 and 214, and the cam portions 70*a* and 70*b* are disposed corresponding to the each cylinder 211, 212, 213 and 214 respectively.

In the drawing, 4 cylinders are formed to the engine, but it is not limited thereto.

The camshaft 30 may be an intake camshaft or an exhaust camshaft.

In the drawing, the cam 71 and 72, for driving valves 200, is formed as a pair, but it is not limited thereto.

To the cam portions 70*a* and 70*b*, a cam cap connecting portion 76 for engaged with the cam cap 40 is formed between the first and the second cams 71 and 72. The cylinder head 10 and the cam cap 40 are connected with each other and the cam cap connecting portion 76 is rotatably disposed between the cam cap 40 and the cylinder head 10.

The cam 71 and 72 rotate and open the valve 200.

A cam key 74 is formed to the first and second cam portions 70*a* and 70*b* respectively and a first sliding hole 86 and a second sliding hole 88 are formed to the first and second inner brackets 80 and 81 respectively.

A cam key pin 82 of which a cam key slot 83 where the cam key 74 is slidably inserted therein is formed thereto and the cam key pin 82 is rotatably inserted into the each first sliding hole 86.

Camshaft holes 32 are formed to the camshaft 30 and a plurality of camshaft pin 60 is inserted into the camshaft hole 32 to be connected to the camshaft 30. And a slider pin 84 of which a camshaft pin slot 85 where the camshaft pin 60 is slidably inserted therein is formed thereto and the slider pin 84 is rotatably inserted into the each second sliding hole 88.

A slider housing bearing 92 is disposed between the slider housing 90*a* and 90*b* and the inner bracket 80 and 81 respectively. Thus, rotations of the inner brackets 80 and 81 may be easily performed. In the drawings, the slider housing bearing 92 is depicted as a needle bearing, however it is not limited thereto. On the contrary, various bearings such as a ball bearing, a roller bearing and so on may be applied thereto.

A shaft hole 42 where the control shaft 95 is inserted into is formed to the cam cap 40 and a shaft bearing 44 is inserted into the shaft hole 42 and rotatably supporting the control shaft 30.

A guide slot 46 is formed to the cam cap 40 and a guide shaft 93 inserted into the guide slot 46 and of which a rack gear 94 is formed thereto is protruded from the slider housings 90*a* and 90*b*.

A pinion gear 96 is formed to the control shaft 95 and engaged with the rack gear 94 and the positions of the slider housings 90*a* and 90*b* are changed according to rotation of the control shaft 95.

A bushing 48 is inserted into the guide slot 46 for reducing frictional force of the movement of the guide shaft 30.

A stopper 50 is disposed to the cam cap 40 for limiting the movement of the slider housings 90*a* and 90*b*.

The control portion 100 includes a worm wheel 102 connected to the control shaft 95, a worm gear 104 engaged with the worm wheel 102 and a control motor 106 selectively rotating the worm gear 104.

The first inner bracket 80 disposed within the first slider housing 90*a* may include two inner bracket elements 80*a* and 80*b* and each inner bracket element 80*a* and 80*b* may rotate independently.

The second inner bracket 81 disposed within the second slider housing 90*b* may include two inner bracket elements 81*a* and 81*b* and each inner bracket element 81*a* and 81*b* may rotate independently.

A partition 91 is disposed within the first and second slider housings 90*a* and 90*b* respectively for preventing from interrupting of the rotations of the inner brackets 80 and 81.

Thus, interrupting of the rotations of inner bracket element 80*a*, 80*b*, 81*a* and 81*b* may be prevented.

A guide surface 98 is formed to the first and second slider housings 90*a* and 90*b* and a guider 12 is formed to the cylinder head 10 for contacting the guide surface 98 and guiding movements of the first and second slider housings 90*a* and 90*b*.

As shown in FIG. 5, for example, an engine with a first, second, third and fourth cylinders 211, 212, 213 and 214 may be provided with two first and second cam portions 70*a* and 70*b*, two inner brackets 80 and 81, two slider housings 90*a* and 90*b* and one control motor 106 and perform changing duration of each cam 71 and 72. Thus, the continuously variable valve duration apparatus according to an exemplary embodiment of the present invention may reduce numbers of elements, thus durability may be improved and operation stability may be obtained.

Figure 7:
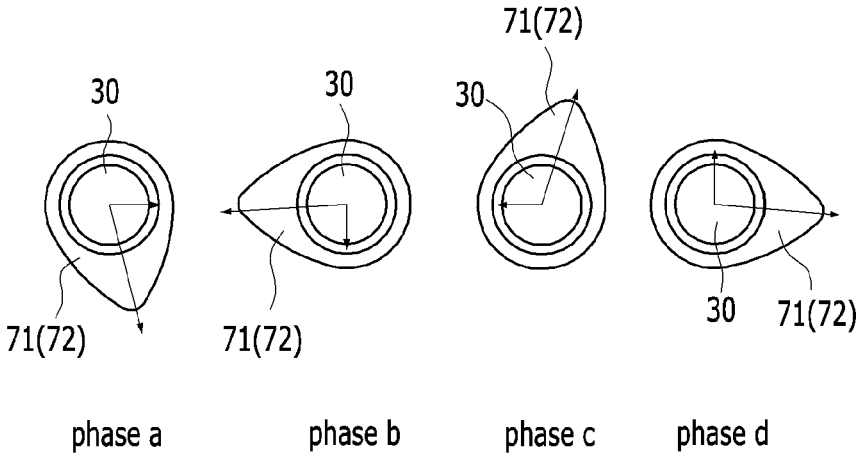
FIG. 7 and FIG. 8 are drawings showing mechanical motions of cams of a continuous variable valve duration apparatus according to an exemplary embodiment of the present invention.
Figure 8:
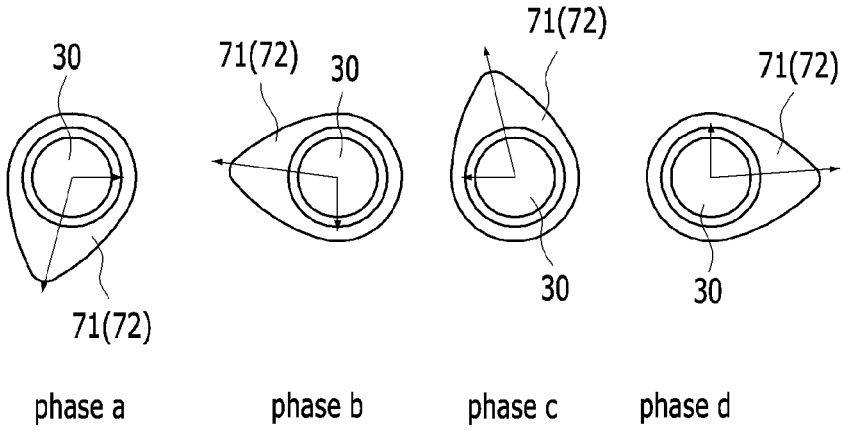

FIG. 7 and FIG. 8 are drawings showing mechanical motions of cams of a continuous variable valve duration apparatus according to an exemplary embodiment of the present invention.

As shown in FIG. 1 to FIG. 6, according to engine operation states, an ECU (engine control unit or electric control unit) transmits control signals to the control motor 106 of the control portion 100 to change the relative position of the first and second slider housings 900 and 90*b* upward or downward.

When the slider housings 90*a* and 90*b* and the inner brackets 80 and 81 moves according to operation of the control motor 106, rotation centers of the inner brackets 80 and 81 with respect to the camshaft 30 are changed.

As shown in FIG. 7, while the phase angle of the camshaft 30 is constantly changed when the relative rotation center of the cams 71 and 72 with respect to the rotation center of the camshaft 30 is changed downward, the rotation speed of the cams 71 and 72 is relatively faster than rotation speed of the camshaft 30 from phase a to phase b and from phase b to phase c, then the rotation speed of the cams 71 and 72 is relatively slower than rotation speed of the camshaft 30 from phase c to phase d and from phase d to phase a. That is, the valve duration is changed.

As shown in FIG. 8, while the phase angle of the camshaft 30 is constantly changed when the relative rotation center of the cams 71 and 72 with respect to the rotation center of the camshaft 30 is changed upward, the rotation speed of the cams 71 and 72 is relatively slower than rotation speed of the camshaft 30 from phase a to phase b and from phase b to phase c, then the rotation speed of the cams 71 and 72 is relatively faster than rotation speed of the camshaft 30 from phase c to phase d and from phase d to phase a. That is, the valve duration is changed.

While the camshaft pin 60 is rotated together with the camshaft 30, the camshaft pin 60 is slidable within the camshaft pin slot 85, the slider pin 84 is rotatably inserted into the second sliding hole 88, the cam key pin 82 is rotatably inserted into the first sliding hole 82, and the cam key 74 is slidable within the cam key slot 83. Thus the relative rotation speed of the cams 71 and 72 with respect to the rotation speed of the camshaft 30 is changed.

Figure 9:
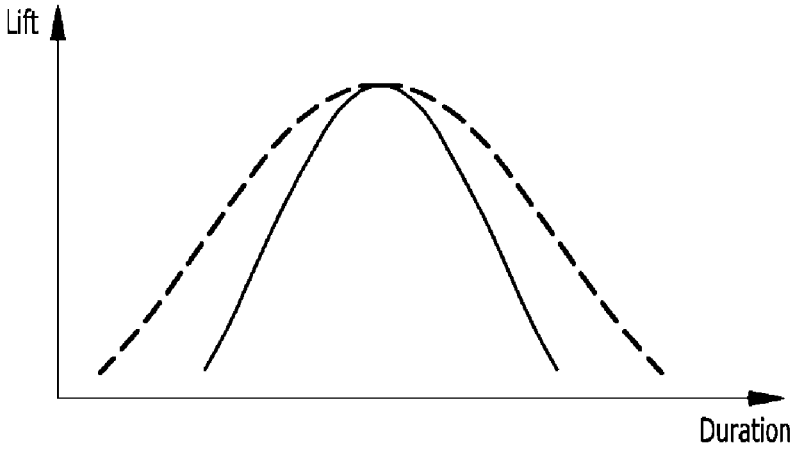
FIG. 9 and FIG. 10 are graphs of a valve profile of a continuous variable valve duration apparatus according to an exemplary embodiment of the present invention.
Figure 10:
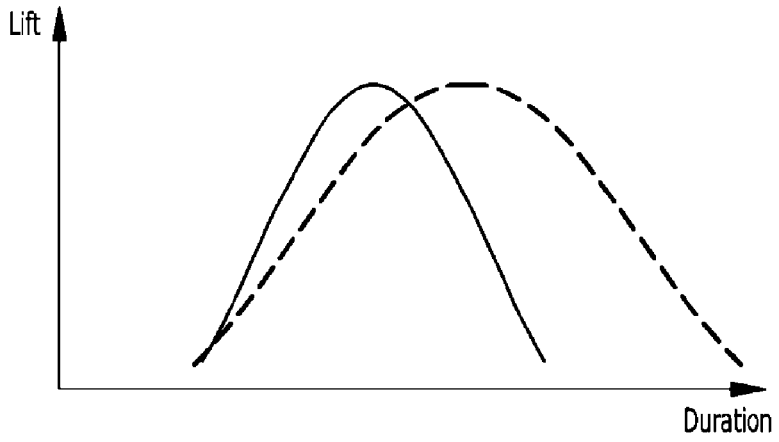

FIG. 9 and FIG. 10 are graphs of a valve profile of a continuous variable valve duration apparatus according to an exemplary embodiment of the present invention.

As shown in FIG. 9 and FIG. 10, although maximum lift of the valve 200 is constant, however rotation speed of the cam 71 and 72 with respect to the rotation speed of the camshaft 30 is changed according to relative positions of the slider housings 90*a* and 90*b* so that closing and opening time of the valve 200 is changed. That is, duration of the valve 200 is changed.

According to adjusting mounting angle of the valve 200, forming the guide surface 98 and the guider 12 and so on, valve duration may be enlarged by advancing opening timing and retarding closing timing of the valve 200 as shown in FIG. 9. Or, valve duration may be shortened by retarding opening timing and advancing closing timing of the valve 200.

Also, as shown in FIG. 10, opening timing of the valve 200 may be constant and closing timing of the valve 200 may be retarded or advanced as requested.

Also, closing timing of the valve 200 may be constant and opening timing of the valve 200 may be retarded or advanced as requested.

As described above, the continuous variable valve duration apparatus according to an exemplary embodiment of the present invention may perform various valve duration according to adjusting mounting angle of the valve 200, forming the guide surface 98 and the guider 12 and so on.

The continuous variable valve duration apparatus according to an exemplary embodiment of the present invention may be reduced in size and thus the entire height of a valve train may be reduced.

Since the continuous variable valve duration apparatus may be applied to an existing engine without excessive modification, thus productivity may be enhance and production cost may be reduced.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A continuous variable valve duration apparatus comprising:

a camshaft;

first and second cam portions of a cam formed thereto respectively, of which the camshaft is inserted thereto first and second inner brackets transmitting rotation of the camshaft to the first and second cam portions respectively;

first and second slider housings of which the first and second inner brackets are rotatably inserted thereto;

a cam cap rotatably supporting the first and second cam portions respectively and of which each of the first and second slider housings is slidably mounted thereto;

a control shaft disposed parallel to the camshaft and engaged with the first and second slider housings for selectively moving the first and second slider housings; and a control portion configured for selectively rotating the control shaft for changing positions of the first and second inner brackets.

2. The continuous variable valve duration apparatus of claim 1, wherein a cam key is formed to the first and second cam portions respectively; and a first sliding hole is formed to the first and second inner brackets respectively; and a cam key pin of which a cam key slot where the cam key is slidably inserted therein is formed thereto wherein the cam key pin is rotatably inserted into each first sliding hole.

3. The continuous variable valve duration apparatus of claim 2, wherein a second sliding hole is formed to the first and second inner brackets respectively, and a plurality of camshaft pins is connected to the camshaft; and a slider pin of which a camshaft pin slot where each camshaft pin is slidably inserted therein is formed thereto and the slider pin is rotatably inserted into each second sliding hole.

4. The continuous variable valve duration apparatus of claim 1, wherein a shaft hole where the control shaft is inserted into is formed to the cam cap.

5. The continuous variable valve duration apparatus of claim 4, further comprising a shaft bearing inserted into the shaft hole and rotatably supporting the control shaft.

6. The continuous variable valve duration apparatus of claim 1, wherein a guide slot is formed to the cam cap;

a guide shaft inserted into the guide slot and of which a rack gear is formed thereto is protruded from the first and second slider housings; and a pinion gear is formed to the control shaft and engaged with the rack gear; and wherein positions of the first and second slider housings are changed according to rotation of the control shaft.

7. The continuous variable valve duration apparatus of claim 6, further comprising a bushing inserted into the guide slot for reducing frictional force of movement of the guide shaft.

8. The continuous variable valve duration apparatus of claim 6, further comprising a stopper disposed to the cam cap for limiting movement of the slider housing.

9. The continuous variable valve duration apparatus of claim 1, further comprising a slider housing bearing disposed between the first and second slider housings and the first and second inner brackets respectively.

10. The continuous variable valve duration apparatus of claim 1, wherein the cam is formed as a pair of two cams;

a cam cap connecting portion is formed between the two cams of the first and second cam portions; and the cam cap rotatably supports the cam cap connecting portion.

11. The continuous variable valve duration apparatus of claim 1, wherein the control portion comprises:

a worm wheel connected to the control shaft;

a worm gear engaged with the worm wheel; and a control motor selectively rotating the worm gear.

12. The continuous variable valve duration apparatus of claim 1, further comprising a partition disposed within the first and second slider housings respectively for preventing from interrupting of rotations of the first and second inner brackets.

13. An engine comprising:

a camshaft;

two first and second cam portions of a cam formed thereto respectively, of which the camshaft is inserted thereto and a cam key is formed thereto respectively;

a plurality of camshaft pins connected to the camshaft;

first and second inner brackets transmitting rotation of the camshaft pins to each cam key respectively;

first and second slider housings of which the first and second inner brackets are rotatably inserted thereto;

cam caps rotatably supporting the first and second cam portions together with a cylinder head and of which the first and second slider housings are slidably mounted thereto respectively;

a control shaft disposed parallel to the camshaft and engaged with the first and second slider housings for selectively moving the first and second slider housings; and a control portion configured for selectively rotating the control shaft for changing positions of the first and second inner brackets.

14. The engine of claim 13, wherein the control portion comprises:

a worm wheel connected to the control shaft;

a worm gear engaged with the worm wheel; and a control motor selectively rotating the worm gear.

15. The engine of claim 13, wherein first and second sliding holes are formed to the first and second inner brackets respectively, and a cam key pin of which a cam key slot where the cam key is slidably inserted therein is formed thereto and the cam key pin is rotatably inserted into each first sliding hole; and a slider pin of which a camshaft pin slot where each camshaft pin is slidably inserted therein is formed thereto and the slider pin is rotatably inserted into each second sliding hole.

16. The engine of claim 13, further comprising a slider housing bearing disposed between the first and second slider housings and the first and second inner brackets respectively.

17. The engine of claim 13, wherein the cam is formed as a pair of two cams; and a cam cap connecting portion is formed between the two cams of the first and second cam portions, wherein a cam cap connecting portion is rotatably disposed between the cam cap and a cylinder housing.

18. The engine of claim 13, wherein a guide slot is formed to the cam cap; and a shaft hole where the control shaft is inserted into is formed to the cam cap, and wherein the engine further comprises a shaft bearing inserted into the shaft hole and rotatably supporting the control shaft.

19. The engine of claim 13, wherein a guide slot is formed to the cam cap;

a guide shaft inserted into the guide slot and of which a rack gear is formed thereto is protruded from the slider housing; and a pinion gear is formed to the control shaft and engaged with the rack gear, and wherein positions of the first and second slider housings are changed according to a rotation of the control shaft.

20. The engine of claim 13, wherein a guide surface is formed to the first and second slider housings; and a guider is formed to the cylinder head for contacting the guide surface and guiding movements of the first and second slider housings.

* * * * *